United States Patent [19]

Thomas, Jr.

[11] Patent Number: 5,007,579

[45] Date of Patent: Apr. 16, 1991

[54] FIBERBOARD CYLINDRICAL CONTAINER WITH SPIRALLY WOUND TUBULAR BODY AND CLOSURE THEREFOR

[76] Inventor: Henry H. Thomas, Jr., 9 William St., Rumson, N.J. 07760

[21] Appl. No.: 574,110

[22] Filed: Aug. 29, 1990

[51] Int. Cl.[5] ..... B65D 3/10

[52] U.S. Cl. ..... 229/5.5; 229/4.5; 229/922; 229/DIG. 12

[58] Field of Search ..... 229/4.5, 5.5, 5.8, 922, 229/DIG. 12; 206/497

[56] References Cited

U.S. PATENT DOCUMENTS

| | | | |
|---|---|---|---|
| 1,297,152 | 3/1919 | Hackney | 229/5.5 |
| 2,149,625 | 3/1939 | Pabst | 229/23 |
| 2,180,882 | 11/1939 | Royal | 229/5.5 |
| 2,392,959 | 1/1946 | Van Saun | 229/5.5 |
| 2,406,758 | 9/1946 | Gazette | 229/4.5 |
| 3,383,025 | 5/1968 | Ferrey et al. | 229/5.5 |
| 3,641,732 | 2/1972 | Fujio | 229/DIG. 12 |
| 4,347,934 | 9/1982 | Goodman | 229/4.5 |

*Primary Examiner*—Gary E. Elkins

*Attorney, Agent, or Firm*—Hoffman, Wasson & Gitler

[57] ABSTRACT

A cylindrical container consisting of a spirally wound paperboard tube, and a pair of closures for sealing the upper and bottom ends thereof. Each closure is formed of a pair of die-cut paperboard discs glued together over a large common surface area so that the discs are warp-resistant. The discs differ slightly in size, so that the smaller disc can engage the interior of the tubular body in a friction-fitting relationship, while the larger disc provides an annular ring to receive the edge of the tubular body. The spirally wound paperboard tube possesses significant axial strength, so that several containers can be stacked thereon, and also possesses sufficient hoop strength to resist deformation or denting, under normal conditions of use.

7 Claims, 1 Drawing Sheet

FIG. 1
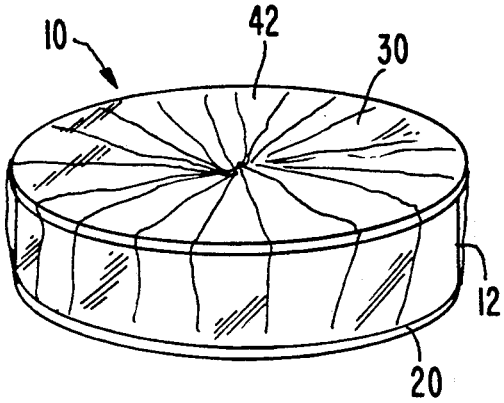
FIG. 2
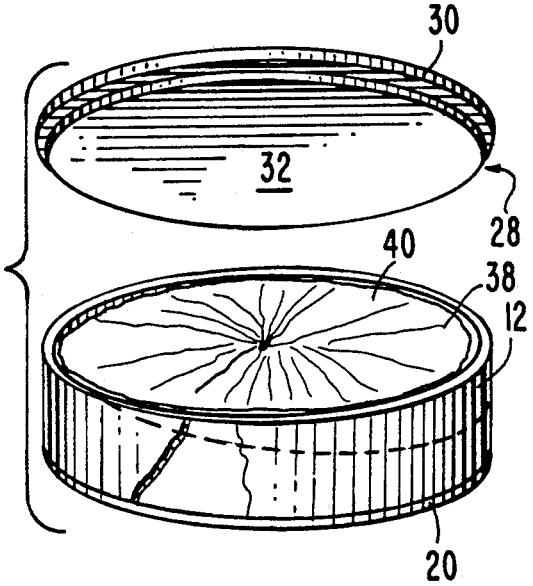
FIG. 3
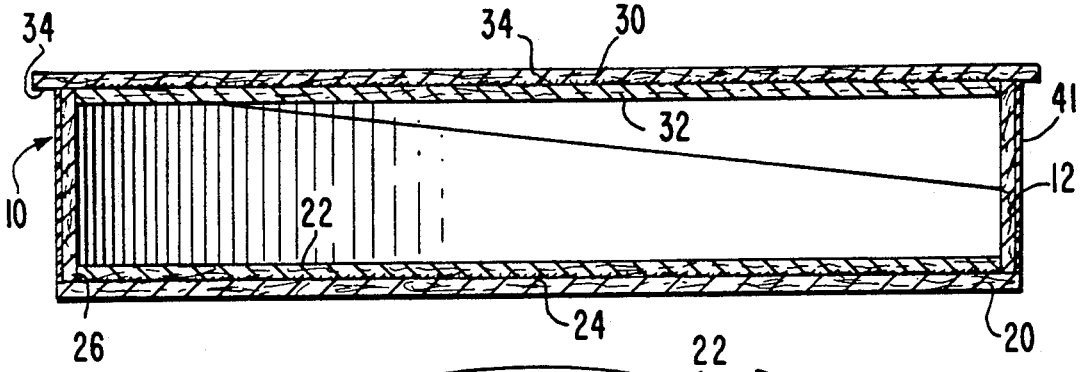
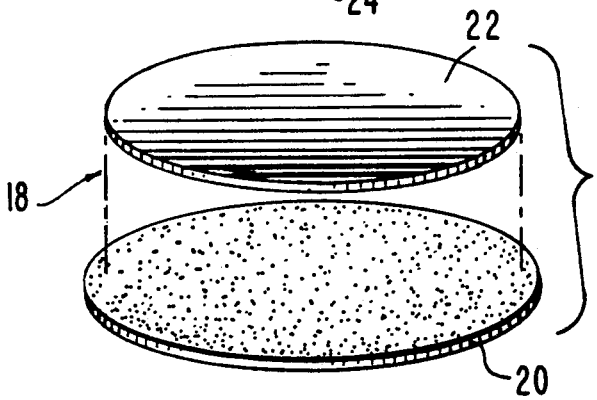
FIG. 4
FIG. 5
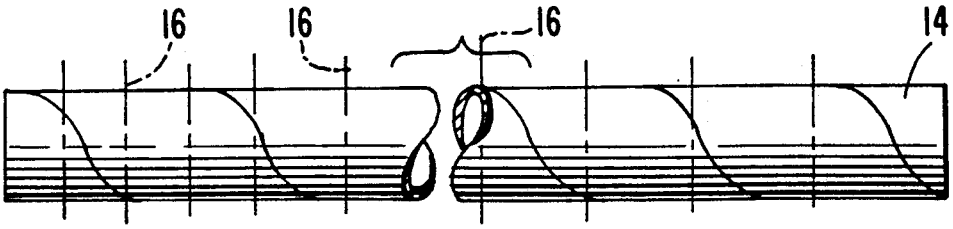

FIBERBOARD CYLINDRICAL CONTAINER WITH SPIRALLY WOUND TUBULAR BODY AND CLOSURE THEREFOR

FIELD OF THE INVENTION

The instant invention relates generally to cylindrical containers manufactured, from paperboard, and comprising a cylindrical body with closures frictionally fitting into the opposite ends thereof. More specifically, the invention pertains to cylindrical containers wherein the cylindrical body is fabricated from a spirally wound paperboard tube, and the closures are formed of paperboard discs secured together.

BACKGROUND OF THE INVENTION

Cylindrical containers have been used for several years as attractive, aesthetically pleasing, packages for a wide variety of products. To illustrate, such containers have been used as packages for powder puffs, dusting powder, talcum powder, and other toiletries. Such containers have been formed from corrugated, or other low strength, paper.

U.S. Pat. No. 2,149,625, granted Mar. 7, 1939 to Hans Pabst, discloses a cylindrical container including a cylindrical body formed by inserting lock 8 on the belt (or body) into slot 7. A bottom closure for sealing the lower end of the container is formed by securing smaller disc 2 to larger disc 1, as shown in FIGS. 1 and 2 of the Pabst patent. A similar closure for sealing the upper end of the container is formed by securing two discs together, as shown in FIG. 4 of the Pabst patent. A slot-like, grooved rim 2-3 is formed in each closure to receive teeth 4, 5 on the belt. The teeth 4, 5 fold about score lines 6 and slip into grooved rim 2, 3 to secure the closures at the opposite ends of the cylindrical container.

The cylindrical container shown in Pabst, however, relies upon the proper alignment, and interengagement, of teeth 4, 5 and grooved rims 2, 3 of the closures. Such interengagement, once established, would have to be destroyed in order to open the container, thus precluding repeated usage of the container as a sewing box, food storage box, general storage medium, etc. Also, because of the necessity of accurate alignment of the teeth with the grooves in the end closures, there are many components to manufacture and assemble, the body of the container is relatively weak, and the end closures are of reduced strength because the two discs, for each end closure, may exhibit a tendency to separate from each other.

Other cylindrical containers, executed in paper, are shown in U.S. Pat. No. 1,297,152, granted to Hackney, and U.S. Pat. No. 3,383,025 granted to Ferrey et al. These containers are made of two, or more, plies of corrugated fiber board; these plies are not secured to each other, and allow slippage during the assembly process. Ferry et al proposes a peripheral skirt 23, and a band or strap (note column 2, lines 51–54) to resist outward deformation of the container when subjected to loading.

Cylindrical containers have also been used to receive food products, such as fruit cakes, cookies, and the like. While low strength paper was, and is, acceptable for forming small cylindrical containers, with low strength requirements, as used for cosmetics, the food products called for better looking, sturdier, more sanitary, and longer lasting cylindrical containers. Cylindrical containers, executed in metal, and commonly known as "tin containers", have dominated the up-scale food packaging industry for years. Such tin containers are sturdy, attractive, can be re-used, and present a neat, shiny, and sanitary appearance that compliments the food product retained therein.

While the "tin containers" are widely used, the containers are costly, hard to ship, space consuming to store, and are thus limited, by practical considerations, for use with up-scale, relatively expensive food products that can be sold at a premium price. Additionally, most of the tin containers are made abroad, and significant problems are encountered with ordering and shipping to match production schedules. Food packers, and similar large scale users of tin containers, have thus sought alternative packages, of equal strength and durability, for several years, but without noticeable success. Also, printing upon the "tin containers" is difficult and costly.

BRIEF DESCRIPTION OF THE INVENTION

With the deficiencies of the prior art paperboard and "tin" containers clearly in mind, the instant invention contemplates a relatively inexpensive, easily fabricated, and attractive cylindrical container that can be used for a wide variety of products, ranging from flowable powders and cosmetics to prepared food products. Such container employs a cylindrical body formed of a tube of spirally wound paperboard cut to the desired axial length, and closures that fit tightly within opposing ends of the tube. Each closure is formed of a pair of discs secured together over the large common surface area; the discs are formed by die-cutting same from a sheet of paperboard in a continuous, on-line fashion.

The spirally wound paperboard tube possesses far greater axial strength, and radially directed hoop strength, than the multiple plies of corrugated paper frequently used as the body of a cylindrical container. The spirally wound paperboard tube resists denting, scratching, or buckling, and the container so formed can thus be re-used several times. Such capability may permit the instant container to challenge the conventional tin container as the standard for up-scale food products and the like.

Also, the end closures are formed of a larger disc and a smaller disc glued together over the large common surface area. No slots or grooves or other discontinuities are formed between the two discs, so that the end closures resist warping, and can be accurately formed, within narrow tolerances. The resultant closures are inserted into the opposite ends of the tubular body, and the smaller discs establish a friction fit with the opposite ends of the body to seal same. The friction fit, in some instances, is sufficiently secure that no adhesive need to be used to complete the container. In other instances, a bead of adhesive may be needed to retain the bottom end closure, in fixed position, during repeated usage of the container.

Additionally, the instant cylindrical container lends itself to the addition of attractive graphics to the container. A cylindrical band of imprinted paper may be fitted about, or glued to, the tubular body, and decorative paper may be registered with, and secured to, the planar surface of each end closure. Alternatively, the paperboard is receptive to multicolor printing techniques.

Lastly, in one specific application of the innumerable potential applications for the instant invention, the cylindrical container may be used to receive, and retain, a fruit cake, or a rum cake, and the entire package may be shrunk-wrapped with a plastic film. The film surrounds the entire package and significantly increases the shelf life of the enclosed product, and its ability to be shipped significant distances without degradation of the food product. Since the outer diameter of each end closure is flush with, or only slightly greater than the diameter of the spirally wound paperboard tube, the film carefully traces the contour of the container, minimizing voids, and reducing the opportunities for the film layer to be punctured or penetrated.

Other advantages attributable to the instant invention will occur to the skilled artisan from the ensuing description of the preferred embodiment of the invention.

BRIEF DESCRIPTION OF THE DRAWINGS

FIG. 1 is a perspective view of a cylindrical container, constructed in accordance with the principles of this invention, with a layer of plastic film shrunk-wrapped thereover;

FIG. 2 is an exploded perspective view of the cylindrical container with the upper end closure removed to show the contents of the container;

FIG. 3 is a vertical cross-sectional view, on an enlarged scale, of the cylindrical container;

FIG. 4 is an exploded perspective view of the end closure for the cylindrical container; and FIG. 5 is a schematic View of a spirally wound paperboard tube from which the body of the cylindrical container can be cut.

DESCRIPTIoN OF THE PREFERRED EMBODIMENT

FIGS. 1-5, construed in harmony, depict the preferred embodiment of a cylindrical container, indicated generally by reference numeral 10, that is constructed in accordance with the principles of this invention. Container 10 comprises a tubular body 12 that is cut to the desired axial length by severing same from an elongated tube 14 of spirally wound paperboard. The irregularly spaced dotted lines 16 that intersect tube 14 suggest that the tube can be cut to any desired length, and that the resultant tube can be employed, successfully, for diverse purposes.

Bottom end closure 18 comprises a larger disc 20 and a slightly smaller disc 22. Smaller disc 22 is secured to larger disc 20 by glue 24, or a similar adhesive, spread over the large common area between the discs. As best shown in FIG. 3, disc 22 is frictionally engaged within the interior of tubular body 12 and disc 20 is substantially equal in diameter to body 12. The lower edge of tubular body 12 thus engages the annular lip 26 defined between discs 22 and 20 of bottom end closure 18.

In many instances, particularly where the cylindrical container will receive a light load, such as a flowable powder, the friction fit between the end closure 18 and tubular body 12 is sufficiently strong so that adhesives, glues, staples, or other fastening devices may be completely omitted. In other instances, particularly where the cylindrical container is intended to receive a heavier, more dense load, such as a food product, a bead of glue may be used on the lip 26 to increase the tenacity of the joint formed by end closure 18 and the tubular body 12. Alternatively, a bead of glue may be used about the intersection of disc 22 and the interior of tubular body 12.

An upper end closure 28 seals the upper end of tubular body 12, as shown in FIGS. 2 and 3. The upper end closure 28 comprises a larger disc 30 and a slightly smaller disc 32 that is secured thereto by glue, or a similar adhesive, spread over the large common area 34 between the discs. As shown in FIG. 3, the disc 32 is frictionally engaged within the interior of tubular body 12 and disc 30 is slightly greater in diameter than the diameter of body 12. The overhang 34 enables the user of the cylindrical container to grasp upper end closure 28 and remove same from its frictional engagement with body 12, thus granting the user access to the contents of the container.

The interior of the container may contain a food product, such as cake 38. Cake 38 may be wrapped in foil, or may be shrunk-wrapped by film 40, or may be protected by foil or other packaging materials. While the exterior of tubular body 12 may be directly imprinted upon, a decorative band 41 is frequently glued about the body 12; such band may be embossed, engraved, or otherwise decorated to enhance the eye appeal of the container.

After end closures 18, 28 have been inserted into, or engaged with, tubular body 12, and cake 38 fills the interior of body 12, the entire package may be sealed, by a thermoplastic film 42 that is shrunk-wrapped snugly about the periphery of the body 12. Since only overhang 34 projects outwardly from body 12 and end closures 18, 28, the film adheres to the container, with a minimum amount of voids. Thus, the shelf life of cake 38 is prolonged, and the cake may be shipped great distances without concern for degradation of the product, and without any loss of aesthetic appeal for the product.

Bottom end closure 18 is somewhat different than upper end closure 28, for disc 30 extends radially beyond disc 20. However, disc 20 may be enlarged, so that top and bottom ledges may be provided to facilitate opening the cylindrical container. Thus, if desired, the upper and lower end closures would be identical in shape, further simplifying the manufacturing and assembling operations.

The spirally wound paperboard tube must possess significant axial strength, so that cylindrical containers can be stacked upon one another without buckling. Also, the spirally wound paperboard tube must have considerable vault, or hoop, strength to resist deformation, or denting. These characteristics will enable the cylindrical container to be re-used, repeatedly, for extended periods of time.

All of the components for the cylindrical container are made of paperboard; consequently, the container may be used within a microwave oven. While the discs for each closure ar preferably die-cut, other cutting techniques could also be used with equal success. In addition to resisting warpages, the end closures possess great resistance to bending, further enhancing the strength and rigidity of the completed container.

Yet other modifications and revisions will occur to the skilled artisan working in the packaging arts, without departing from the scope of applicant's invention. Consequently, the appended claims should be broadly construed in a manner consistent with the breadth and scope of the instant invention, and should not be limited to their literal terms.

I claim:

1. A cylindrical container consisting of:

(a) a tubular body, (b) a first end closure for sealing the bottom of said tubular body, (c) said first end closure comprising a first disc having a diameter slightly greater than the diameter of said tubular body, a second slightly smaller disc, and an adhesive layer extending over the overlapping area of said discs to permanently join same together, (d) said second disc being sized to create a friction fit with the interior of said tubular body, (e) a second end closure for sealing the top of said tubular body, (f) said second end closure comprising a first disc having a diameter slightly greater than the diameter of said tubular body, a second slightly smaller disc, and an adhesive layer extending over the overlapping area of said discs to permanently join same together, (g) said second disc being sized to create a friction fit with the interior of said tubular body, the invention being characterized in that (h) said tubular body is formed from a length of spirally wound paperboard tube possessing significant axial strength to resist buckling and sufficient hoop strength to resist deformation.

2. The cylindrical container as defined in claim 1 wherein said first and second end closures are identical.

3. The cylindrical container as defined in claim 1 wherein said first disc of said second end closure is slightly larger than said first disc of said first end closure, whereby said top closure may be readily removed from said tubular body to expose the interior of said body.

4. The cylindrical container as defined in claim 1 wherein each end closure is formed of two discs of die-cup paperboard.

5. A cylindrical container comprising:

(a) a tubular body, (b) a first end closure for sealing the bottom of said tubular body, (c) said first end closure comprising a pair of die-cut paperboard discs, (d) one disc being at least as equal in diameter to the exterior of said tubular body, the second disc being slightly smaller in diameter than the interior of said tubular body, and an adhesive layer extending over the overlapping area of said discs to permanently join same together, (e) a bead of adhesive extending about the first end closure between said first and second discs to secure said closure to the bottom of said tubular body, (f) a second end closure comprising a pair of die-cut paperboard discs for sealing the top of said tubular body, (g) said second end closure comprising a first disc having a diameter slightly greater than the diameter of the exterior of said tubular body, a second slightly smaller disc, and an adhesive layer extending over the overlapping area of said discus to permanently join same together, (h) said second disc being sized to create a friction fit with the interior of said tubular body, (i) the invention being characterized in that said tubular body is formed from a spirally wound paperboard tube cut to the desired size, said tube possessing significant axial strength to resist buckling and sufficient hoop strength to resist deformation.

6. The cylindrical container as defined in claim 5 further including a circular band of decorative paper positioned about said tubular body, and glued thereto, to enhance the visual appeal of said container.

7. The cylindrical container as defined in claim 5 further including an exterior layer of thermoplastic film, said film being adapted to be shrunk-wrapped about said container with a minimum number of voids.

* * * * *